US005345763A

United States Patent [19]

Sato

[11] Patent Number: 5,345,763

[45] Date of Patent: Sep. 13, 1994

[54] SECONDARY AIR CONTROL SYSTEM FOR INTERNAL COMBUSTION ENGINE

[75] Inventor: Kazuhiro Sato, Yokohama, Japan

[73] Assignee: Nissan Motor Co., Ltd., Yokohama, Japan

[21] Appl. No.: 13,430

[22] Filed: Feb. 4, 1993

[30] Foreign Application Priority Data

Feb. 27, 1992 [JP] Japan ..... 4-041209

[51] Int. Cl.[5] ..... F01N 3/30

[52] U.S. Cl. ..... 60/290

[58] Field of Search ..... 60/289, 290

[56] References Cited

U.S. PATENT DOCUMENTS

| | | | |
|---|---|---|---|
| 3,750,401 | 8/1973 | Nambu | 60/290 |
| 3,862,540 | 1/1975 | Harvey | 60/209 |
| 3,962,867 | 6/1976 | Ikeura | 60/290 |
| 5,140,810 | 8/1992 | Kuroda | 60/290 |

FOREIGN PATENT DOCUMENTS

| | | | |
|---|---|---|---|
| 2715951 | 10/1978 | Fed. Rep. of Germany | 60/290 |
| 53-9663 | 4/1978 | Japan . | |

*Primary Examiner*—Douglas Hart

*Attorney, Agent, or Firm*—Foley & Lardner

[57] ABSTRACT

In an internal combustion engine having a catalytic converter incorporated in an exhaust passage thereof, there is provided a secondary air control system. The control system comprises an electric air pump by which secondary air is fed to the exhaust passage. An intake air amount detecting device is provided for detecting the amount of air fed to the engine through an intake passage of the engine. A control unit is provided for controlling the voltage applied to the air pump in accordance with the amount of air detected by the intake air amount detecting device. The control is so made that the amount of secondary air fed to the exhaust passage by the air pump is substantially proportional to the amount of air detected by the intake air amount detecting device.

6 Claims, 3 Drawing Sheets

SECONDARY AIR CONTROL SYSTEM FOR INTERNAL COMBUSTION ENGINE

BACKGROUND OF THE INVENTION

1. Field of the Invention

The present invention relates in general to control systems for internal combustion engines, and more particularly to control systems of a type which controls a secondary air fed to the exhaust system of the internal combustion engine.

2. Description of the Prior Art

In automotive internal combustion engines, there is a type in which a secondary air is fed to an exhaust system to burn and thus reduce harmful CO and HC in an exhaust gas from the engine. Usually, the secondary air is fed to the exhaust passage upstream of a catalytic converter, so that the exhaust gas fed to the converter can have a sufficiently high temperature due to burning of CO and HC. With this arrangement, remaining CO and HC in the exhaust gas is effectively burnt in the converter, and thus, the harmful CO and HC in the exhaust gas can be greatly reduced.

However, feeding the catalytic converter with the secondary air sometimes induces an excessive heating of catalyst of the converter, which tends to lower the catalytic activity and shorten the life of the catalyst. In view of this, as is described in Japanese Patent Second Provisional Publication 53-9663, usually, the secondary air feeding is made only at the time when, like at engine idling, CO and HC tend to increase. In fact, in order to obtain a stable running of the engine, a somewhat richer air/fuel mixture is fed to the engine during idling, which however in turn causes an increase of CO and HC in the exhaust gas.

However, even when feeding of the secondary air to the exhaust system is made only at the above-mentioned limited time, excessive air feeding to the system sometimes induces a certain temperature drop in the catalytic converter, which lowers the activity of the catalyst. In fact, the concentration (viz., lightoff performance) of fresh air in the exhaust gas, which allows sufficient exhaust gas oxidation at the lowermost allowable temperature, has been determined. For keeping the dilution of the exhaust gas with the secondary air at a given level, it is preferable to control the amount of the secondary air in proportion to that of the exhaust gas from the engine.

However, in the conventional system disclosed by the above-mentioned publication, the secondary air feeding fails to satisfy the above-mentioned proportional supply. That is, in the system, the secondary air feeding is powered by an air pump which is directly driven by the engine. That is, the amount of the secondary air is controlled so as to be proportional to the rotation speed of the engine, not to the amount of the exhaust gas from the engine.

In view of the above, electrically controlled air pumps have been proposed for controlling the secondary air fed to the exhaust system of the engine. Most of them are of a type in which an electric control valve disposed in a secondary air feeding pipe is controlled to vary its opening. However, in this type, the air pump is subjected to a wasteful operation due to marked pressure drop of the secondary air produced when the air passes through the control valve. Furthermore, since the pressure ratio between the pressure appearing upstream of the control valve (viz., the discharge pressure of the pump) and the pressure appearing downstream of the control valve varies, satisfactory proportional air control is not obtained.

SUMMARY OF THE INVENTION

It is therefore an object of the present invention to provide a secondary air control system for an internal combustion engine, which system is free of the above-mentioned drawbacks.

According to the present invention, there is provided a secondary air feeding system for use in an internal combustion engine which has an intake passage, an exhaust passage and a catalytic converter incorporated in the exhaust passage. The secondary air feeding system comprises an electric air pump of the type which varies a pumping ability thereof in accordance with a voltage applied thereto; a secondary air inlet passage connected to the air pump for feeding the same with a first amount of fresh air; a secondary air outlet passage extending from the air pump to the exhaust passage at a passage upstream of the catalytic converter; an electrically controlled valve disposed in the secondary air outlet passage, the valve being opened only when the air pump is energized; intake air amount measuring means for measuring an intake air amount consisting of a second amount of fresh air which is fed to combustion chambers of the engine through the intake passage, the intake air amount measuring means being substantially unaffected by the air flowing in the secondary air inlet passage; voltage determining means for determining a voltage applied to the electric pump in such a manner that the first amount of fresh air fed to the exhaust passage by the pump through the secondary air outlet passage is proportional to the second amount of fresh air measured by the intake air amount measuring means; and voltage applying means for applying the voltage determined by the voltage determining means to the air pump.

DETAILED DESCRIPTION OF THE INVENTION

Figure 1:
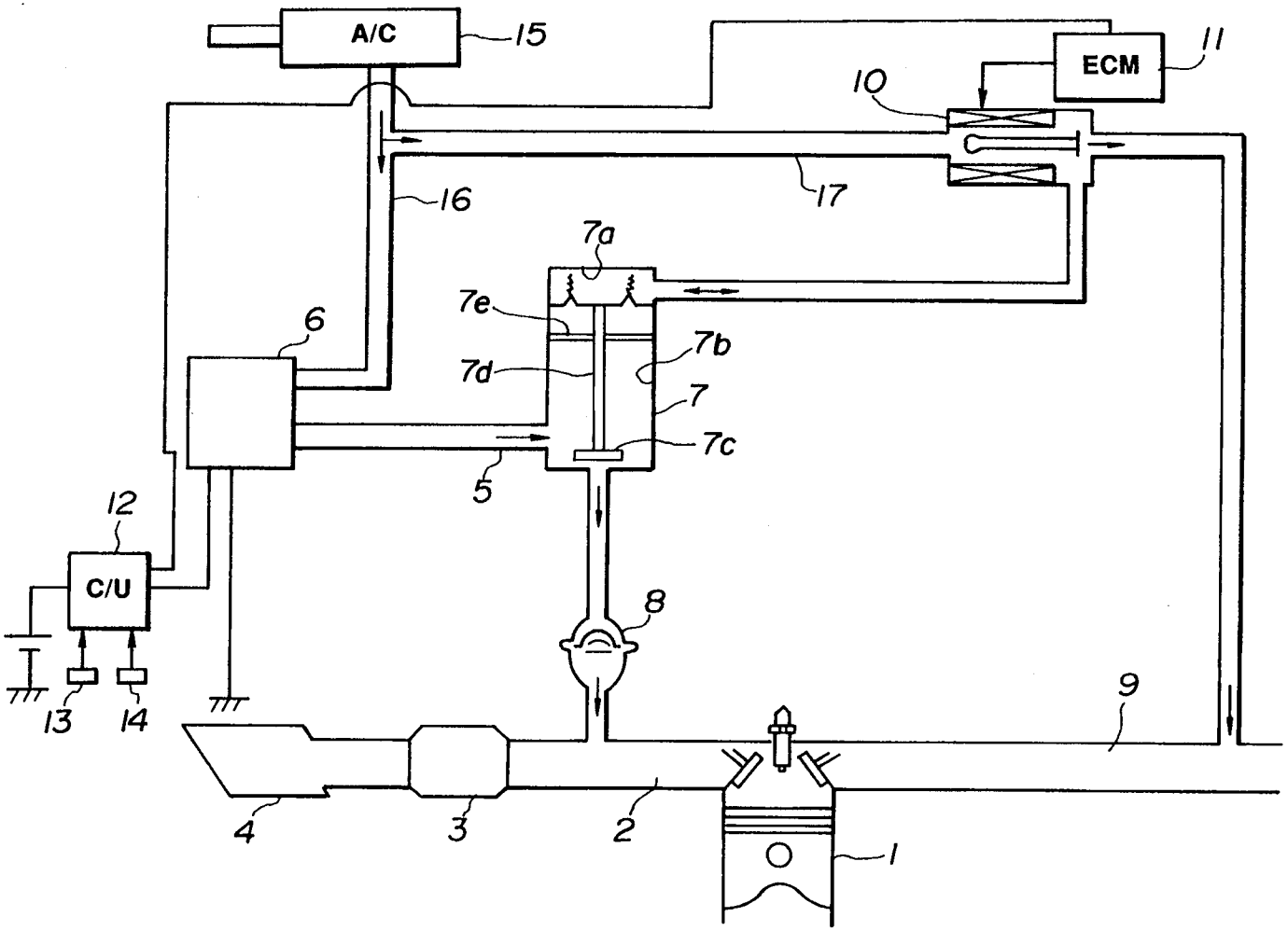
FIG. 1 is a schematic illustration of the secondary air control system according to the present invention.

Referring to FIG. 1 of the drawings, there is schematically shown a secondary air control system according to the present invention.

In the drawing, designated by numeral 1 is an internal combustion engine from which an exhaust passage 2 extends. A catalytic converter 3 (three-way catalyst) is mounted to the exhaust passage 2 at a position downstream of an exhaust manifold of the engine 1, and a muffler 4 is mounted to a downstream or terminal part of the exhaust passage 2.

Connected to the exhaust passage 2 upstream of the catalytic converter 3 is a secondary air outlet passage 5. An electric air pump 6, a diaphragm type valve 7 and a check valve 8 are mounted to the secondary air outlet passage 5 in the illustrated manner. Designated by numeral 15 is an air cleaner from which a cleaned air is fed to the air pump 6 through a secondary air inlet passage 16.

The diaphragm type valve 7 comprises a diaphragm (no numeral) by which first and second chambers *7a* and *7b* are defined. A stem *7d* extends in the second chamber *7b* from the diaphragm and has a valve body *7c* connected to a leading end thereof. Designated by reference *7e* is a supporter for the valve stem *7d*. The second chamber *7b* is connected to an output opening of the air pump 6, while the first chamber *7b* is connected to an electromagnetic valve 10.

The electromagnetic valve 10 is mounted to a passage 17 which connects the passage 16 with an intake passage 9 of the engine 1. An engine control module 11 is connected to the valve 10 to control the same.

As will become apparent hereinafter, when it is judged that the secondary air feeding to the exhaust system is needed, the control module 11 opens the electromagnetic valve 10 thereby to feed the first chamber *7a* of the diaphragm type valve 7 with negative pressure produced in the intake passage 9. Under this condition, the valve body *7c* opens the secondary air feeding passage 5 and thus air from the air pump 6 is fed to the exhaust passage 2 through the check valve 8. While, when it is judged not to need the secondary air feeding, the control module 11 closes the electromagnetic valve 10 thereby to feed the first chamber *7a* with ambient pressure transmitted through the air cleaner 15. Under this condition, the valve body *7c* closes the secondary air outlet passage 5 and thus the secondary air supply to the exhaust passage 2 is stopped.

Furthermore, as will become apparent hereinafter, when the need of secondary air feeding is judged, a control unit 12 drives the air pump 6. The control unit 12 contains a voltage control module which can control the voltage of electric power applied to the electric air pump 6. Information from an air flow meter 13 incorporated in the intake passage 9 to measure the intake air amount fed to combustion chambers of the engine, an engine speed sensor 14 and other known meters is fed to the control unit 12 for allowing the control unit 12 to find out whether the condition of the engine 1 such that it needs the secondary air feeding.

Figure 2:
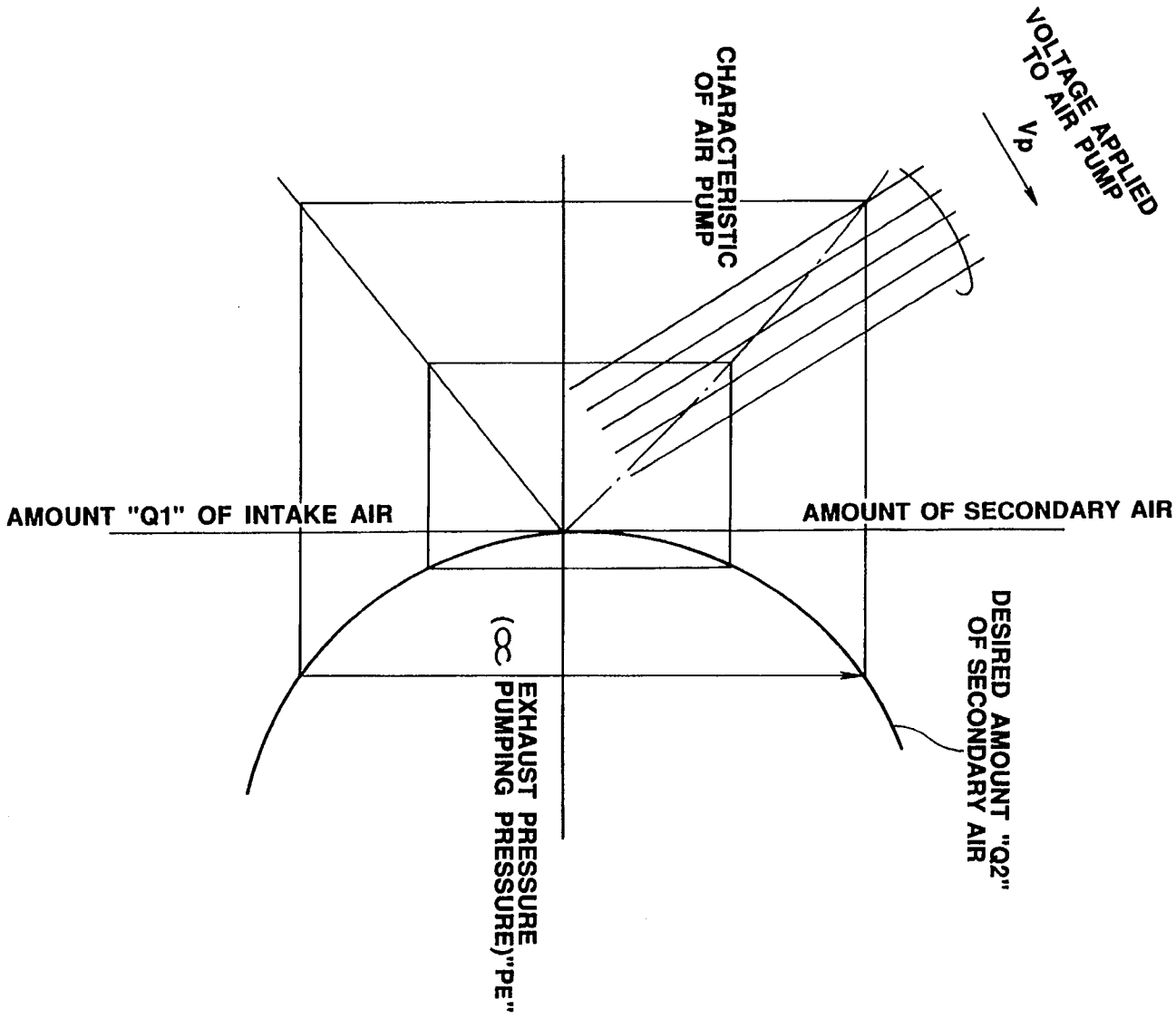
FIG. 2 is a graph showing various conditions of an internal combustion engine with respect to characteristics of an electric air pump.

FIG. 2 is a graph showing the various conditions of the engine 1 with respect to the characteristics of the electric air pump 6. As is understood from the graph, there is a correlation between the intake air amount "Q1" and the exhaust pressure "PE", and there is also a correlation between the exhaust gas amount "QE" and the exhaust pressure "PE". That is:

$$PE = A \times QE^2 \quad (1)$$

(A: constant)

The requested secondary air amount "Q2" is obtained by multiplying the exhaust gas amount "QE" by the dilution rate of the exhaust gas.

The air pump 6 is of a type which uses the voltage of applied electric power as a parameter of the pumping characteristic. The characteristic of the air pump 6 is depicted at the left upper portion of the graph. It is to be noted that from the intersection point between the pumping characteristic curve and the curve of the requested secondary air amount "Q2", the voltage to be applied to the air pump 6 for the requested secondary air amount "Q2" is determined.

With the above-mentioned relationships, a relationship between the intake air amount "Q1" and the voltage applied to the air pump 6 is determined, which is stored in a ROM of the control unit 6 as a reference map. That is, when the intake air amount "Q1" is detected, the necessary applied voltage is looked up from the reference map in the ROM and the voltage is applied to the air pump 6 to drive the same.

Figure 3:
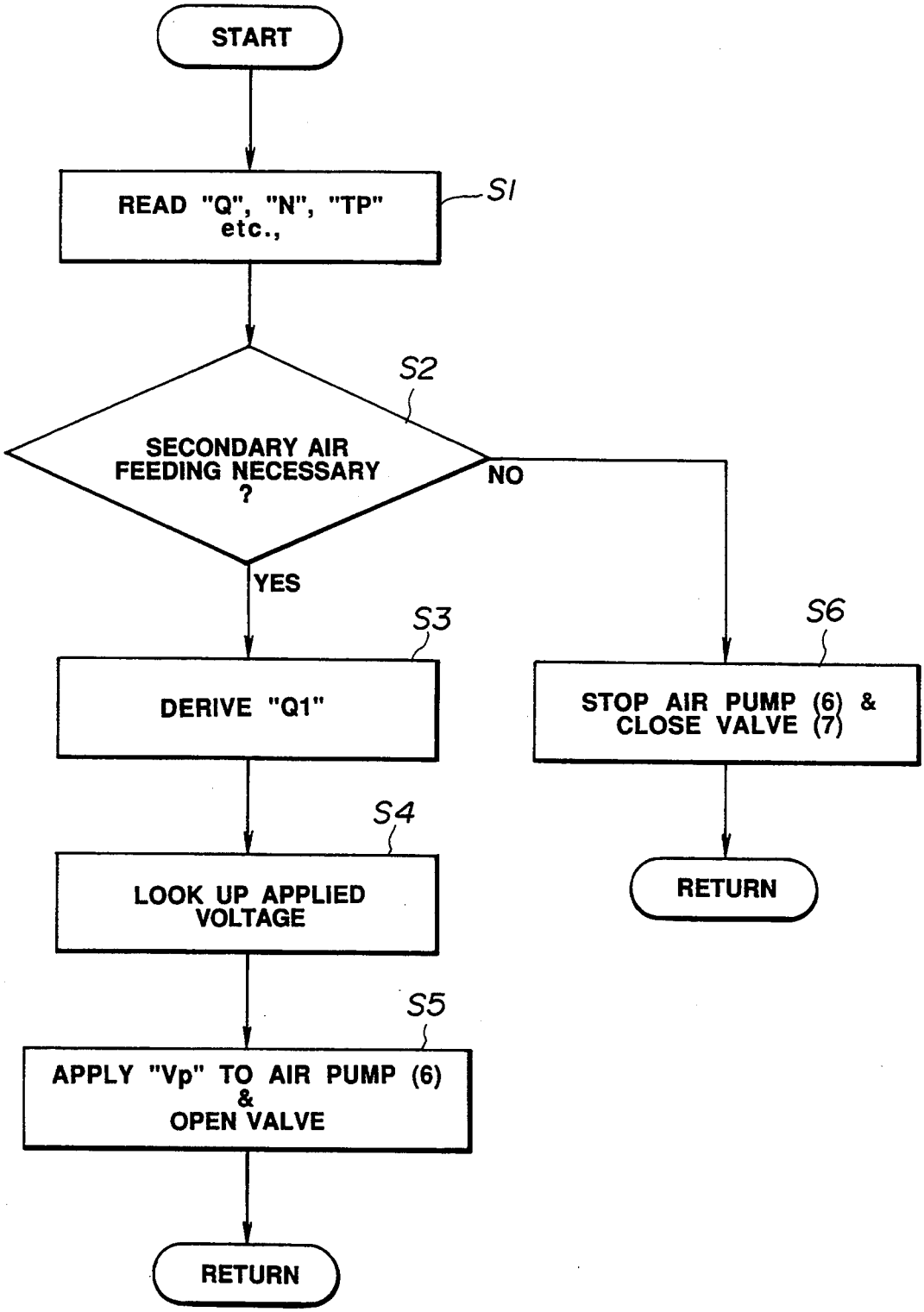
FIG. 3 is a flowchart depicting programmed operation steps carried out in a control unit of the present invention.

FIG. 3 is a flowchart showing programmed operation steps for controlling the secondary air feeding.

At step S1, information on "Q" (intake air amount), "N" (engine speed), etc., from the air flow meter 13, engine speed sensor 14 etc., which represent the operating condition of the engine 1, and information on a base amount "Tp" of fuel to be injected to the engine 1 and the like are read. The base amount "Tp" of fuel is obtained by executing a sub-routine (not shown) for controlling the amount fed to the engine 1.

At step S2, in accordance with the engine operating condition detected, a judgement is carried out as to whether the condition requires the secondary air feeding or not.

If Yes, that is, when the engine operating condition is such that the secondary air feeding is needed, the operation flow goes to step S3 wherein the intake air amount "Q1" is derived. The intake air amount "Q1" can be directly obtained from the information supplied by the air flow meter 13 or indirectly obtained by multiplying the base amount "Tp" of injected fuel by the engine speed "N" If the latter method is used, the influence of pulsation on the value "Q1" can be avoided as the calculation of the base amount "Tp" is executed on the weighted mean of the values "Q" detected by the air flow meter 13. That is, the air flow meter 13 or the function possessed by the step S3 constitutes an intake air amount detecting means.

Then, at step S4, the applied voltage "VP" corresponding to the intake air amount "Q1" is looked up from the afore-mentioned reference map. That is, the ROM which stores the reference map and the function possessed by the seep S4 constitutes an applied voltage determining means.

At step S5, a signal representative of the applied voltage "$V_P$" thus looked up is fed to the voltage control module of the control unit 12, and thus the voltage "$V_P$" is applied to the electric air pump 6 and at the same time, the electromagnetic valve 10 is opened to keep the diaphragm type valve 7 open. Thus, a controlled amount of air is fed by the air pump 6 to the exhaust passage 2 through the secondary air outlet passage 5. It is to be noted that the amount of the secondary air thus fed to the exhaust passage 2 varies in accordance with the voltage "VP" applied to the air pump 6. The voltage control module of the control unit 12 and the function possessed by step S5 thus constitute an applied voltage controlling means.

As is understood from the above, by controlling the voltage applied to the electric air pump 6, the secondary air feeding to the exhaust passage 2 is so made as to keep the dilution rate of the exhaust gas, which is fed to the catalytic converter 3, at the optimum level in accordance with the amount of the exhaust gas from the engine 1. That is, the secondary air control system of the present invention can supply the exhaust gas, which is fed to the three-way catalytic converter 3, with fresh air by the amount suitable for burning unburnt materials, such as CO and HC, remaining in the exhaust gas from the engine 1. Thus, on undesired temperature drop of the exhaust gas caused by excessive air feeding thereto is suppressed, and the catalytic converter 3 can keep its maximum catalytic activity during operation of the engine 1. Accordingly, the harmful CO and HC in the exhaust gas can be highly reduced. Furthermore, since only the necessitated voltage is consumed by the air pump 6, the electric power is economized.

The voltage control module of the control unit 12 is of a type which outputs DC voltage to the air pump 6. However, if desired, the module may be of a duty control type in which ON duty at the output of 12V is 50%. Furthermore, in place of the voltage control module, a measure may be used wherein by using a D/A (digital-/analog) converter, a digital voltage signal is converted to a corresponding analog voltage signal before being applied to the electric air pump 6. The voltage applied to the air pump 6 may be linearly and continuously controlled or stepwisely controlled. In the stepwise control, a plurality of parallel resistors are arranged in the drive circuit and the resistors are selectively switched for the stepwise application of voltage to the air pump 6.

As will be understood from the foregoing description, in the present invention, the amount "Q2" of secondary air fed to the exhaust passage 2 is controlled by changing the voltage applied to the air pump 6 in accordance with the detected value of intake air amount "Q1". Thus, as has been described hereinabove, the harmful CO and HC in the exhaust gas from the engine 1 can be effectively reduced and the electric power used for achieving this secondary air feeding can be economized.

What is claimed is:

1. In an internal combustion engine having an intake passage, an exhaust passage and a catalytic converter disposed in said exhaust passage, a secondary air feeding system comprising:

an electric air pump of a type which varies a pumping ability thereof in accordance with a voltage applied thereto;

a secondary air inlet passage connected to said air pump for feeding the same with a first amount of fresh air;

a secondary air outlet passage extending from said air pump to said exhaust passage at a position upstream of said catalytic converter;

an electrically controlled valve disposed in said secondary air outlet passage, said valve being opened only when said air pump is energized;

intake air amount measuring means for measuring a second amount of fresh air which is fed to combustion chambers of said engine through said intake passage, said intake air amount measuring means being substantially unaffected by said first amount of fresh air flowing in said secondary air inlet passage;

voltage determining means for determining a voltage applied to said electric pump in such a manner that said first amount of fresh air fed to said exhaust passage by said pump through said secondary air outlet passage is proportional to said second amount of fresh air measured by said intake air amount measuring means; and voltage applying means for applying the voltage determined by said voltage determining means to said air pump.

2. A secondary air feeding system as claim in claim 1, wherein said intake air amount measuring means includes an air flow meter which measures directly the amount of air fed to the combustion chambers of said engine through said intake passage.

3. A secondary air feeding system as claimed in claim 2, wherein said secondary air outlet passage has a check valve at a position downstream of said electrically controlled valve.

4. A secondary air feeding system as claimed in claim 3, wherein said electrically controlled valve includes:

a diaphragm type valve having first and second chambers which are bounded by a diaphragm, said second chamber constituting part of said secondary air outlet passage;

a valve body having a valve stem connected to said diaphragm, said valve body closing said part of said secondary air outlet passage when said diaphragm is moved in a given direction; and an electromagnetic valve which, when said air pump is under operation, connects said first chamber of said diaphragm type valve to said intake passage of said passage.

5. A secondary air feeding system as claimed in claim 1, wherein said intake air amount measuring means includes:

means for determining a base amount of fuel which is to be injected into said combustion chambers of said engine;

means for detecting a rotation speed of said engine; and means for multiplying said base amount by said engine rotation speed.

6. A secondary air feeding system as claimed in claim 1, wherein said voltage determining means includes means for locking up a given map which shows a relationship between an intake air amount and said voltage.

* * * * *